United States Patent [19]

Grebe

[11] Patent Number: 4,487,138

[45] Date of Patent: Dec. 11, 1984

[54] TRAVELING GRATE FOR A FURNACE

[76] Inventor: Gerhard Grebe, Schlossbergstrasse 7, D-6345 Eschenburg Roth, Fed. Rep. of Germany

[21] Appl. No.: 449,796

[22] Filed: Dec. 14, 1982

[30] Foreign Application Priority Data

Dec. 15, 1981 [DE] Fed. Rep. of Germany ..... 3149548

[51] Int. Cl.[3] ..... F23H 11/00

[52] U.S. Cl. ..... 110/269; 110/103; 110/234; 110/329

[58] Field of Search ..... 110/103, 234, 267, 268, 110/269, 327, 328, 329, 270, 271, 272, 330

[56] References Cited

U.S. PATENT DOCUMENTS

| | | | |
|---|---|---|---|
| 1,423,540 | 7/1922 | Poppenhusen | 110/269 |
| 1,456,649 | 5/1923 | Poppenhusen | 110/269 |
| 1,522,595 | 1/1925 | Schurtz | 110/269 |
| 1,597,109 | 8/1926 | Poppenhusen | 110/269 |
| 1,930,584 | 10/1933 | Cope et al. | 110/269 |
| 3,962,977 | 6/1976 | Calame et al. | 110/329 |

FOREIGN PATENT DOCUMENTS

| | | |
|---|---|---|
| 595147 | 3/1934 | Fed. Rep. of Germany . |
| 912001 | 5/1954 | Fed. Rep. of Germany . |

*Primary Examiner*—Edward G. Favors
*Assistant Examiner*—Steven E. Warner
*Attorney, Agent, or Firm*—Flynn, Thiel, Boutell & Tanis

[57] ABSTRACT

A traveling grate for a furnace. The grate is formed of plural pipes through which flows a cooling medium, in particular water. The grate also includes plural movable chains. Grate plate guide flanges are arranged laterally on the pipes. The guide plates, which are connected to the chain rest on the guide flanges. The upper strand of each movable chain is guided in an additional chain guide. The lower strand serves to move ash which has fallen through the grate away to a collection station.

Due to the heat discharge through the pipes, the heating performance of the grate can be increased or at a given heating performance an elevated life span can be achieved. Fluid which can be heated up in the pipes can be used profitably, for example to preheat boiler heat.

17 Claims, 3 Drawing Figures

TRAVELING GRATE FOR A FURNACE

FIELD OF THE INVENTION

The invention relates to a traveling grate for a furnace, comprising at least one rotating continuous chain, on which grate plates are arranged, guide wheels or sprockets located at the ends of the grate, over which sprockets the chain is guided, and grate plate guide bars for supporting the grate plates on an upper strand of the rotating chain.

BACKGROUND OF THE INVENTION

Traveling grates for furnaces have the advantage of being capable of continuous operation with practically all solid fuel materials. The supply of fuel is possible in a convenient manner by pouring it onto the front end of the grate, whereat the fuel ignites due to the burning material which is already on the grate. The continually onmoving grate moves the material slowly in the direction toward the grate end. Following a certain traveling time, fuel is distributed over the entire grate. The speed of movement of the grate is selected by considering the various influencing parameters so that the fuel, upon arrival at the grate end, is burned out. Combustion residues can at the end of the grate fall directly into an ash cart. Combustion residues which fall through the grate along said grate will be moved by the returning strand of the chain toward the feed end and can there be collected by a further ash cart.

The stress of heat on the building material creates problems in traveling grates. The heat performance in relationship to the surface unit of the grate is limited by the heat resistance of the grate material. Due to the great amount of heat stress the lifespan of traveling grates is also limited.

The basic purpose of the invention is to provide a traveling grate of the above-mentioned type such that at a given heat performance per surface unit, the heat stress of the grate material is reduced.

This purpose is attained according to the invention by arranging a system of pipes extending parallel with respect to the upper strand of the rotating chain, which pipes form parts of the grate and are adapted to have a heat absorbing fluid flow therethrough.

In a so-constructed traveling grate, a large amount of heat is discharged within the grate by transfering it to a fluid. Generally, one will use water as a cooling fluid. The pipe system can preferably be connected to a boilerplant, for example can serve to preheat boiler feed water. Other utilizations of the heat which is transferred to the fluid are also possible. Due to the intensive amount of cooling, the grate temperature is reduced as a whole and through this the lifespan of the grate is increased. However, it is also possible to utilize the invention in the sense that at a constant lifespan of the grate in comparison to the noncooled grates, the heat performance of the grate is increased.

A particularly preferable construction is obtained by providing guide flanges on the pipes. It is particularly preferable to form the guide flanges on the pipes. The grate plate guide flanges which are united with the pipes have the advantage of providing a particularly good heat transfer and a simple construction. A very large portion of the discharged heat is conveyed through the portion of the pipe wall into the cooling fluid flowing through the pipes.

In the case of a traveling grate having several parallel chains it is particularly preferable to provide between two chains only one pipe, so that alternately chains and pipes are arranged side by side. However, embodiments also fall within the scope of the invention wherein on one pipe only one guide flange is arranged, so that the number of pipes is twice as great as the number of chains.

All pipes can be connected at their ends by collecting pipes. However, it is also possible to connect only some pipes with one another or each pipe can be supplied separately with fluid. Such an arrangement opens up the possibility of supplying various zones of the grate with varyingly large amounts of cooling fluid.

It is also preferable to provide an additional guide which is associated with the upper strand of the chain. Through this one obtains a particularly exact chain guide, which extends the lifespan of the grate.

Recesses in the grate plates permit an intensive air supply thereby enhancing and enabling a maintaining of the heat performance per surface unit. Combustion air can, however, travel through the spaces between adjacent grate plates.

Advantageous relative and absolute dimensions are not important because, in principle, the inventive traveling grate can be built in almost any size.

The pipes can have various cross sections. A circular cross section is preferable.

BRIEF DESCRIPTION OF THE DRAWINGS

One exemplary embodiment of the invention is illustrated in the drawings, in which.

DETAILED DESCRIPTION

Figure 1:
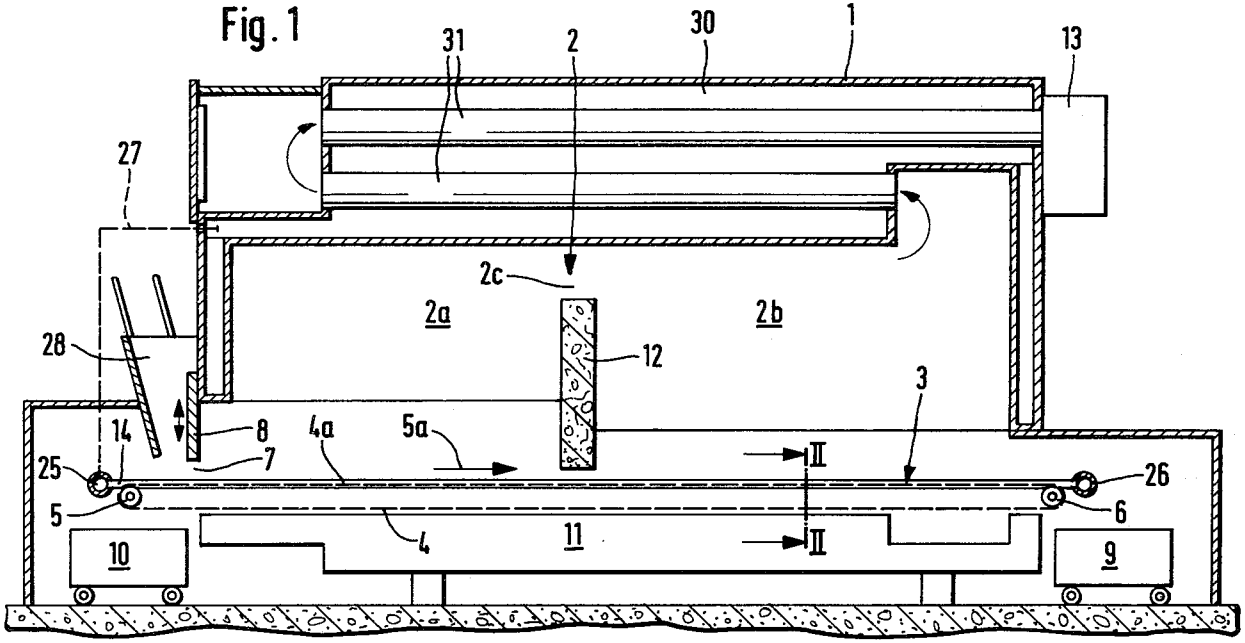
FIG. 1 is a schematical central longitudinal cross-section of a boiler plant having a traveling grate.

A combustion chamber which is identified as a whole by the reference numeral 2 is provided below a tubular boiler 1, the bottom of which combustion chamber is formed by a traveling grate 3 arranged on a support frame 11.

The traveling grate consists of several rotating endless chains 4, which are guided over guide wheels or sprockets 5 and 6. The direction of movement of the upper chain strand 4*a* is indicated by the arrow 5*a*. Above the front or feed end of the grate (left end of FIG. 1) there is provided a chute 28 for supplying solid fuel to the grate. The height of the outlet slot 7 can be altered by varying the height of a retaining wall 8 above the traveling grate to thereby enable a controlling of the height of the layer of fuel deposited on the traveling grate.

At the end of the traveling grate (right end in FIG. 1) there is provided an ash cart 9 into which is deposited combustion residues which have reached the end of the grate. At the feed end of the grate there is provided a further ash cart 10, into which is deposited ash moved by the chains 4 in a manner which will yet be described.

The combustion chamber 2 is divided into a front part 2*a* and a rear part 2*b* by an upright baffle plate 12. The parts 2*a* and 2*b* of the combustion chamber are connected to one another through a passageway 2*c* located above the baffle plate. At the right end of the combustion chamber part 2*b*, the combustion gas travels through smoke pipes 31 contained in a smoke pipe part 30 and thence into an exhaust chamber 13.

The design of the boiler plant with traveling grate described above is known in principle. New is the construction of the traveling grate itself and which is discussed hereinbelow primarily in reference to FIGS. 2 and 3.

Figure 2:
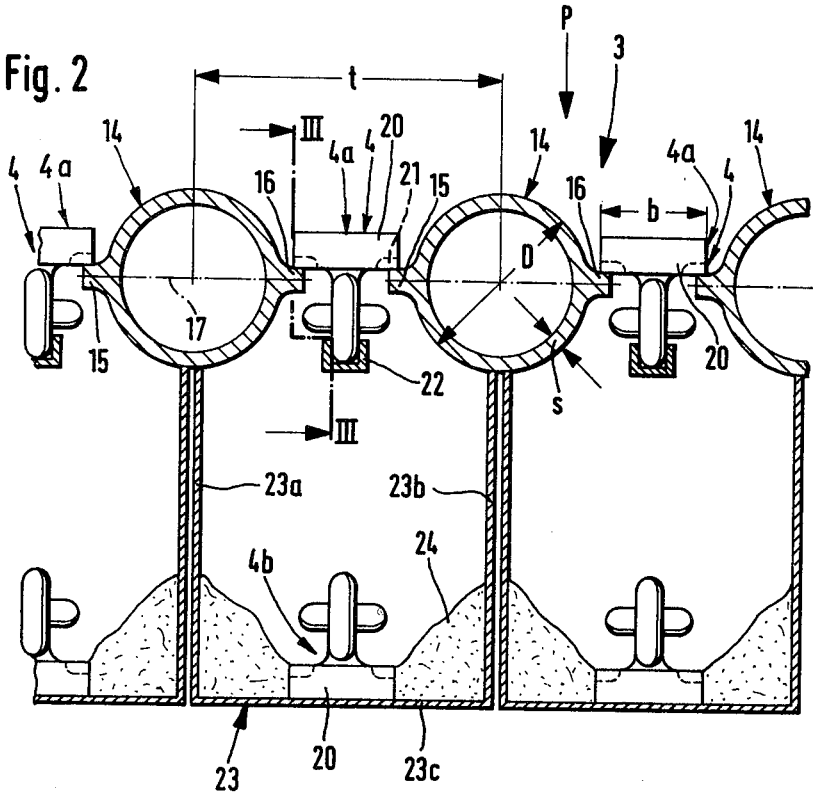
FIG. 2 is an enlarged partial cross-sectional view taken along the line II—II of FIG. 1.

FIG. 2 illustrates only a small portion of the entirety of the traveling grate 3 in cross section. The grate is composed substantially of several parallel extending chains 4 and pipes 14, which are arranged alternately side by side. The pipes 14 have substantially a circular cross section and are located between mutually one of the upper reaches 4*a* of the chains 4. Guide flanges 15 and 16 project radially from each of the pipes 14 and lie in a horizontal diametrical plane 17 of the pipes. The pipes are, for example, made of a heat resistant steel or of a heat resistant cast iron.

Figure 3:
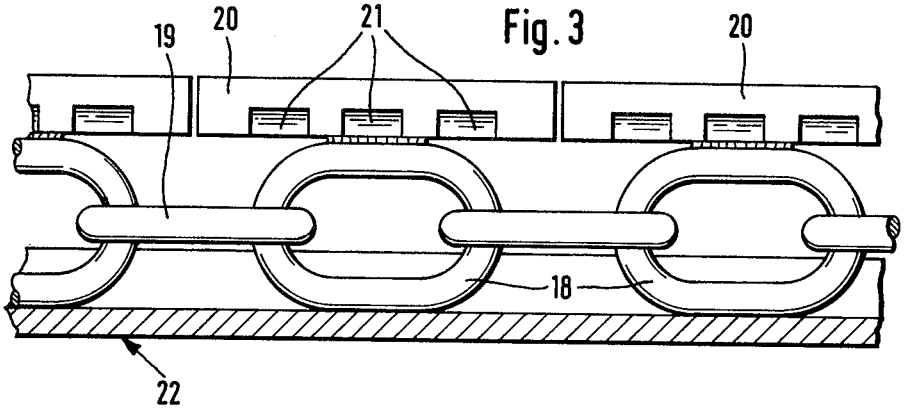
FIG. 3 is a partial cross-sectional view taken along the line III—III of FIG. 2.

The chains 4 are composed of members or links 18 and 19 (FIG. 3). The members 18 lie in a vertical plane and the members 19 lie in a horizontal plane. Grate plates 20 are weldably secured to the vertical members 19. The lateral edges of the grate plates are provided with recesses or notches 21 which facilitate the passage of combustion air therethrough. The lateral edges of the grate plates also rest on the guide flanges 15, 16, as is illustrated in FIG. 2.

The upper reach of the vertical chain members 18 are received and guided for movement in an elongated guide channel 22, which causes the upper reach or chain strand 4*a* to be guided in a straight manner between the pipes 14. Thus, the chain guiding function is not performed by the pipes 14. The pipes 14 thus only have the purpose of carrying or supporting the weight of the upper reach of chain strand 4*a*.

Below the upper reach or chain strand 4*a*, there is arranged an elongated box or tray 23 having upright, vertical side walls 23*a* and 23*b*, the upper edges of which are connected to the underside of the pipes 14. The lower strand 4*b* of the chain 4 travels along the bottom wall 23*c* of said channellike box or tray, namely, in such a manner that the surfaces on the grate plates 20 which earlier were facing upwardly, slidingly engage the bottom wall. Ash 24 which has fallen through the grate is moved by the lower strand 4*b* in a direction toward the feed end of the grate (left end of the grate viewed in FIG. 1), whereat it is deposited in the ash cart 10.

Collecting pipes or header pipes 25 and 26 extend transversely with respect to the pipes 14 at the ends of the grate (see FIG. 1). All longitudinally extending pipes 14 are connected to said collecting pipes. For example, cold water can be supplied through the collecting pipe 26, which water is heated up on the way along the grate (in a direction opposite to the grate movement direction 5) and is removed in the collecting pipe 25. The heat which is contained in the hot water is utilized, for example, by supplying it as hot boiler feed water through the schematically indicated connection 27 to the boiler 1.

The dimensions of the grate can vary in wide limits. The length l of the grate is in the range of 500 to 10,000 mm. The width of the grate, measured at a right angle with respect to the direction of movement of the chains, can be up to approximately 3,000 mm. The distance t separating two mutually adjacent pipes 14 is in the range of 60 mm to 200 mm. The outside diameter D of the pipes 14 is in the range of 38 mm to 159 mm. A well suited diameter is 60 mm. The wall thickness s of the pipes 14 depends naturally on its diameter. As an example, it is stated that for an outside diameter D of approximately 60 mm, the wall thickness s is approximately 4 mm.

FIG. 2 illustrates a size relationship (ratio, relative size) between the width b of the grate plates 20 and the diameter D of the pipes 14, which can be considered as practical. In the case of the illustrated relationships in size, viewed in the direction of the arrow P in FIG. 2, more than half of the grate surface is formed by the pipes 14.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A traveling grate for a furnace, comprising: two horizontally extending pipes which are parallel and horizontally spaced, each said pipe having thereon a guide flange which extends longitudinally thereof and projects horizontally toward the other of said pipes; means for facilitating flow of a cooling fluid through said pipes; an endless chain and means movably supporting said endless chain so that an upper reach thereof is disposed between, extends substantially parallel to, and moves in a direction substantially parallel to said pipes; and a plurality of grate plates supported on said endless chain at respective locations therealong, each said grate plate on said upper reach of said endless chain being above said upper reach, extending generally horizontally, and having each of its lateral edges slidably engaging an upper surface of a respective one of said guide flanges on said pipes; including a plurality of said parallel, horizontally extending, horizontally spaced pipes, each said pipe having two said guide flanges located on diametrically opposite sides thereof; and including a plurality of said endless chains having said plural grate plates supported thereon, the upper reach of each said endless chain being disposed between and extending parallel to a respective pair of said pipes.

2. A traveling grate according to claim 1, wherein said guide flanges are integral with said pipes.

3. A traveling grate according to claim 1, wherein said means for causing a cooling fluid to flow through said pipes includes each of said pipes being connected at one end to a first header pipe and being connected at the other end to a second header pipe.

4. A traveling grate according to claim 1, wherein the portion of the upper surface of said traveling grate which is defined by surfaces on said pipes is in the range of 50% to 80% of the entire upper surface of said grate.

5. A traveling grate according to claim 4, wherein said portion of the upper surface of said grate which is formed by surfaces of said pipes is approximately 65% of the entire upper surface of said grate.

6. A traveling grate according to claim 1, wherein the distance between the centerlines of adjacent said pipes is in the range of 60 mm to 200 mm.

7. A traveling grate according to claim 6, wherein the distance separating said centerlines of adjacent said pipes is 100 mm.

8. A traveling grate according to claim 1, wherein the length of said traveling grate is in the range of 500 mm to 10,000 mm, and wherein the width of said traveling grate is in the range of 100 mm to 3,000 mm.

9. A traveling grate according to claim 1, wherein said pipes each have a generally circular cross section.

10. A traveling grate according to claim 1, wherein said pipes are a portion of a pipe system which is in fluid communication with a boiler.

11. A traveling grate according to claim 1, wherein said means for facilitating flow of a cooling fluid through said pipes includes means for facilitating a flow of the cooling fluid through said pipes in a direction opposite said direction of movement of said upper reach of said endless chain.

12. A traveling grate for a furnace, comprising: two horizontally extending pipes which are parallel and horizontally spaced, each said pipe having thereon a guide flange which extends longitudinally thereof and projects horizontally toward the other of said pipes; means for facilitating flow of a cooling fluid through said pipes; an endless chain and means movably supporting said endless chain so that an upper reach thereof is disposed between, extends substantially parallel to, and moves in a direction substantially parallel to said pipes; and a plurality of grate plates supported on said endless chain at respective locations therealong, each said grate plate on said upper reach of said endless chain being above said upper reach, extending generally horizontally, and having each of its lateral edges slidably engaging an upper surface of a respective one of said guide flanges on said pipes; wherein below the upper reach of said endless chain is provided chain guide means which includes an upwardly open, U-shaped channel which slidably receives the bottom part of vertical chain links of said upper reach of said endless chain.

13. A traveling grate for a furnace, comprising: two horizontally extending pipes which are parallel and horizontally spaced, each said pipe having thereon a guide flange which extends longitudinally thereof and projects horizontally toward the other of said pipes; means for facilitating flow of a cooling fluid through said pipes; an endless chain and means movably supporting said endless chain so that an upper reach thereof is disposed between, extends substantially parallel to, and moves in a direction substantially parallel to said pipes; and a plurality of grate plates supported on said endless chain at respective locations therealong, each said grate plate on said upper reach of said endless chain being above said upper reach, extending generally horizontally, and having each of its lateral edges slidably engaging an upper surface of a respective one of said guide flanges on said pipes; including means defining recesses in said grate plates which are each in fluid communication with regions above and below said upper reach of said endless chain for facilitating passage of combustion gases from the region below to the region above said endless chain.

14. A traveling grate according to claim 13, wherein at least some of said recesses are defined by laterally extending slots provided in the undersides of said grate plates.

15. A traveling grate according to claim 14, wherein at least some of said recesses are defined by openings provided through said grate plates.

16. A traveling grate for a furnace, comprising: two horizontally extending pipes which are parallel and horizontally spaced, each said pipe having thereon a guide flange which extends longitudinally thereof and projects horizontally toward the other of said pipes; means for facilitating flow of a cooling fluid through said pipes; an endless chain and means movably supporting said endless chain so that an upper reach thereof is disposed between, extends substantially parallel to, and moves in a direction substantially parallel to said pipes; and a plurality of grate plates supported on said endless chain at respective locations therealong, each said grate plate on said upper reach of said endless chain being above said upper reach, extending generally horizontally, and having each of its lateral edges slidably engaging an upper surface of a respective one of said guide flanges on said pipes; including an upwardly open U-shaped tray disposed below said pipes and having a generally horizontal bottom wall and generally vertical side walls which extend upwardly from opposite lateral edges of said bottom wall, the upper end of each said side wall being secured to a respective one of said pipes; and wherein said grate plates on the lower reach of said endless chain are slidably supported on the upper side of said bottom wall of said tray and cause residue in said tray to be conveyed toward one end thereof.

17. A traveling grate for a furnace, comprising: two horizontally extending pipes which are parallel and horizontally spaced, each said pipe having thereon a guide flange which extends longitudinally thereof and projects horizontally toward the other of said pipes; means for facilitating flow of a cooling fluid through said pipes; an endless chain and means movably supporting said endless chain so that an upper reach thereof is disposed between, extends substantially parallel to, and moves in a direction substantially parallel to said pipes; and a plurality of grate plates supported on said endless chain at respective locations therealong, each said grate plate on said upper reach of said endless chain being above said upper reach, extending generally horizontally, and having each of its lateral edges slidably engaging an upper surface of a respective one of said guide flanges on said pipes; wherein every other link of said endless chain has a respective said guide plate fixedly secured thereto; wherein minimal spacing is provided between adjacent ends of adjacent said guide plates; and wherein each said guide plate has in the undersurface thereof a slot which communicates with and extends inwardly from a side surface of such guide plate.

* * * * *